United States Patent [19]

Podd et al.

[11] Patent Number: 4,893,839

[45] Date of Patent: Jan. 16, 1990

[54] MOVABLE INDEX SHEET UNIT

[75] Inventors: George O. Podd; Robert J. Mangler, both of Chicago; Anne J. Marsland, Schaumburg, all of Ill.

[73] Assignee: Wilson Jones Company, Chicago, Ill.

[21] Appl. No.: 272,368

[22] Filed: Nov. 17, 1988

[51] Int. Cl.[4] ..... B42D 15/00

[52] U.S. Cl. ..... 283/65; 402/79; 281/38

[58] Field of Search ..... 283/65; 229/84, 92.7; 402/79; 281/38

[56] References Cited

U.S. PATENT DOCUMENTS

| | | | |
|---|---|---|---|
| 1,243,626 | 10/1917 | Pinkerton | 229/92.7 |
| 2,064,749 | 12/1936 | Huber | 283/65 |
| 4,580,814 | 4/1986 | Berler | 283/65 |

*Primary Examiner*—Paul A. Bell
*Assistant Examiner*—Thomas Hamill Jr.
*Attorney, Agent, or Firm*—Pennie & Edmonds

[57] ABSTRACT

A movable index mounted on a base sheet for reciprocal movement which movement is controlled, guided and limited by track means and track-follower means.

4 Claims, 2 Drawing Sheets

MOVABLE INDEX SHEET UNIT

BACKGROUND OF THE INVENTION

Movable information sheet display arrangements are old (U.S. Pat. Nos. 694,001, 854,069, 2,291,573 and 2,452,231). In addition, information displays movable from a concealed position to a display position are old (see U.S. Pat. No. 694,001). Prior housing arrangements for containing index means and the track arrangements for controlling and limiting such index movement have not been found to be satisfactory.

SUMMARY OF THE INVENTION

Broadly, the present invention comprises a stationary base sheet having spaced-apart deflectable projections and a reciprocating index sheet positionable on the base sheet for movement back and forth thereon such index sheet having spaced-apart slots for receiving the base sheet projections so that the projections guide the reciprocal index sheet and function as stops to limit such reciprocation.

It is a feature that the base sheet is covered with a cover sheet which cover sheet together with the base sheet act as opposing guide sheets to house, guide and control the interleaved index sheet. The cover sheet also deflects and holds deflectable projections in their deflected positions.

It is also a feature that projections are formed as partial cutouts of the base sheet.

DESCRIPTION OF THE PREFERRED EMBODIMENT

Figure 1:
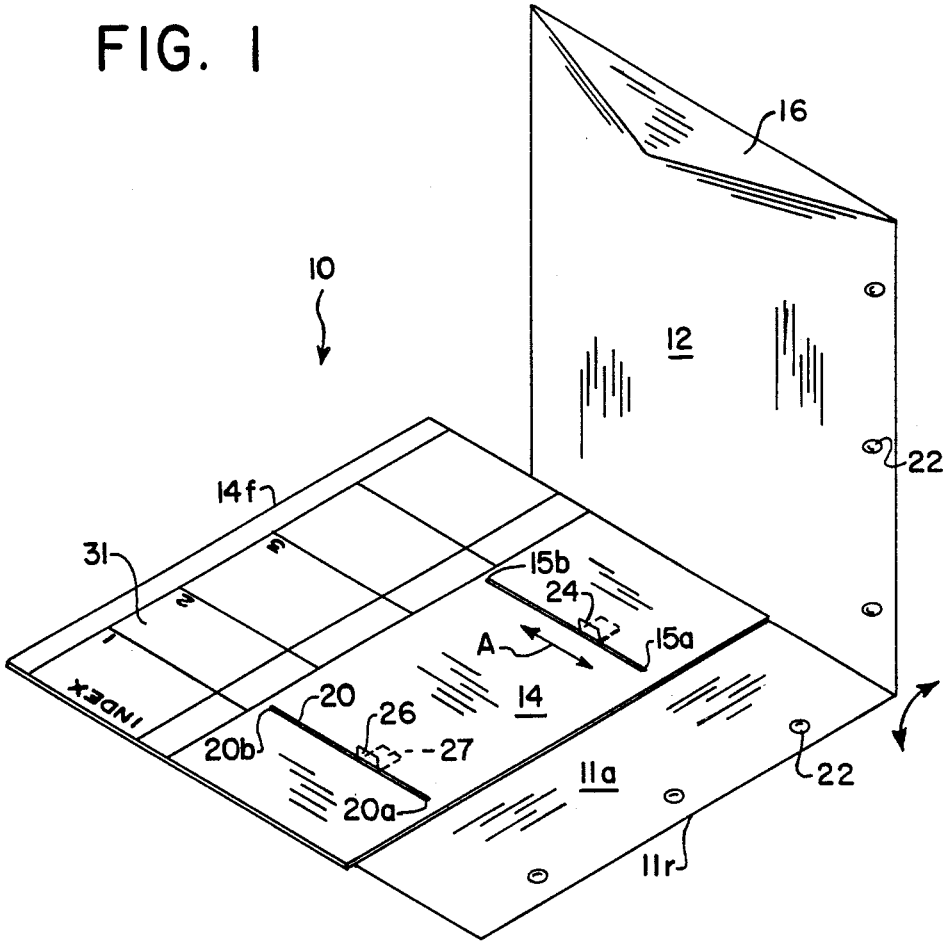
FIG. 1 is a perspective view of the movable index unit with the cover raised position ready for assembly.
Figure 2:
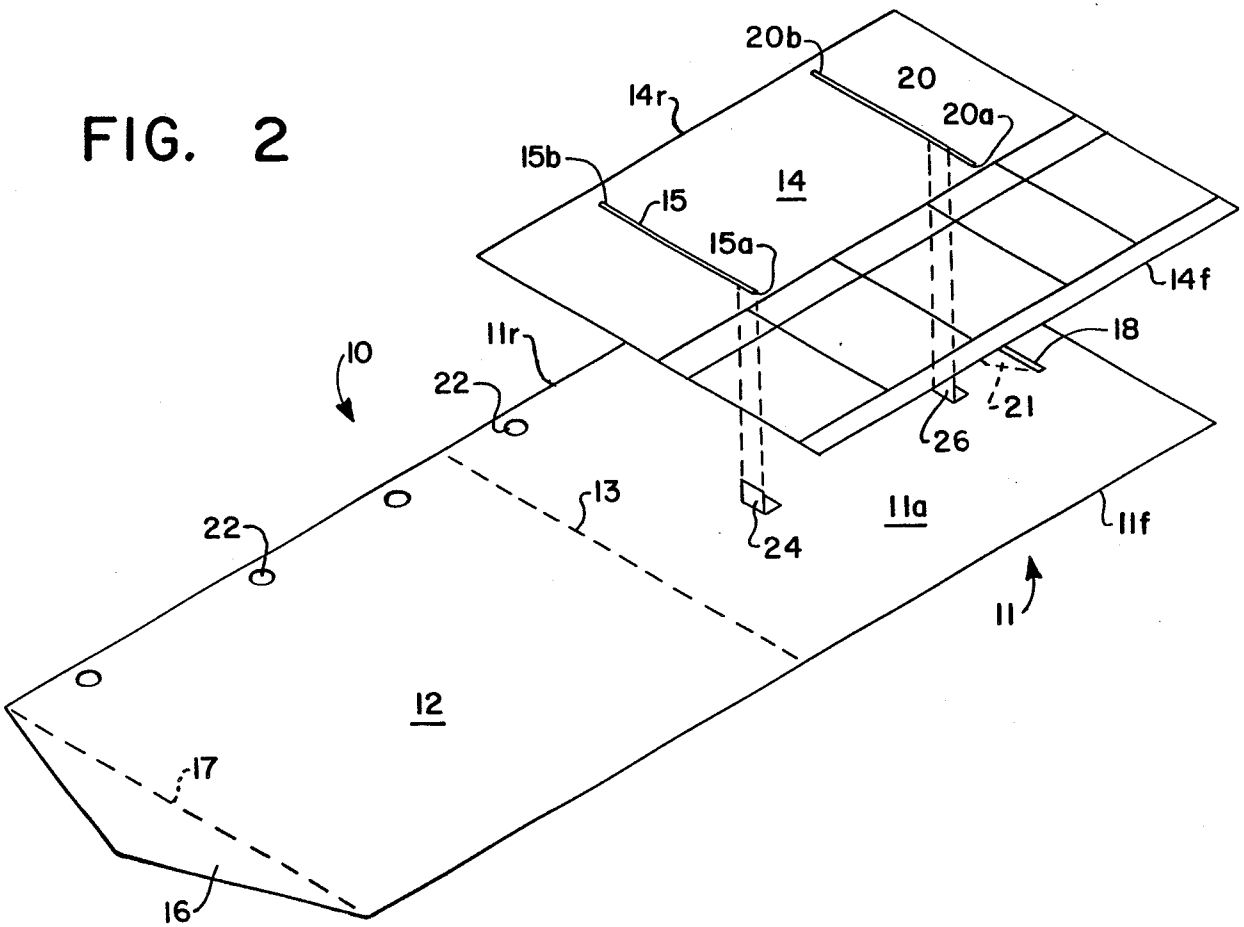
FIG. 2 an exploded perspective view of the unit with the base sheet and cover in an open position.

In FIGS. 1 and 2, movable index unit 10 includes stationary base sheet 11 having top or inside planar surface **11*a* and bottom or outside planar surface 11*b* (not shown) and cover sheet 12 attached along fold line 13 and separate movable index sheet 14. Sheet 11 also has forward edge 11*f* and rearward edge 11*r*. Cover sheet 12 includes flap 16 folded along fold line 17 when assembled and tucked into base sheet slot 18 entering from a direction toward surface 11*b* (a portion of flap 16 appearing as dotted line 21; FIG. 2). Base sheet 11 and cover sheet 12 carry punch holes 22 for use with ring binders or other punched sheet holders. All portions of unit 10** are preferably made from paper, cardboard or plastic sheet stock.

Base sheet 11 has cutout flexible projection tabs 24, 26 which are insertable into index elongated slots 15, 20 of index sheet 14. Track slots 15, 20 which are cut all the way through sheet 14 have slot ends **15*a*, 15*b* and 20*a*, 20*b*. Base sheet 11 is rectangular with forward edge 11*f* and rearward edge 11*r* and index sheet has forward edge 14*f* and rearward edge 14*r*. Projections 24, 26 are bent over to lie flat as illustrated by dotted line 27 of FIG. 1 or partially deflected in response to the positioning of cover 12 as further explained. Index sheet 14 has index portion 31** with index information printed or written on it such as "index", "1", "2" and "3".

In assembly and operation of unit 10, index sheet 14 is placed on surface **11*a* of base sheet 11 with tabs 24, 26 threaded through elongated slots 15 and 20. Cover sheet 12 is then flded down and flap 16 wrapped around base sheet 11 and finally flap 16 is threaded through slot 18 from a direction toward surface 11*b* to complete assembly. Projection tabs 24, 26 are caused to deflect and fold down to a horizontal position as shown by dotted lines 27 or some lesser deflected position. As so assembled, index sheet 14 is ready for reciprocation by sliding sheet 14 in direction of arrow A (FIG. 1). Parallel slots 15, 20 with slot ends 15*a*, 15*b*, 20*a*, 20*b* are of selected length and position so that index sheet 14 is limited in movement by slot ends 15*a*, 15*b*, 20*a*, 20*b* engaging respective track-follower tabs 24, 26. Preferably, index sheet 14 reaches one limit to its motion when nested fully within and between base sheet 11 and cover sheet 12 wherein forward edges 11*f* and 14*f* are adjacent. The other limit occurs when index portion 31 is extended sufficiently beyond base sheet 11 and cover sheet 12 for complete index viewing. Tabs 24 and 26 in their track slots 15, 20 prevent complete removal of index sheet 14 from unit 10**.

I claim:

1. A movable index sheet unit comprising a base sheet having a forward and a rear edge such base sheet having a first and second spaced-apart track follower means;

a movable index sheet with forward and rear edges having slot track means to permit reciprocation of the index sheet guided by the track follower means within limits from an exposed position for complete index viewing in which the forward index sheet edge is remote from the forward base sheet edge to a retracted position;

the track follower means including tab means formed from and extending from the base sheet through the track slot means and bent to be oriented in a plane substantially parallel to the base sheet.

2. The movable index sheet unit of claim 1 in which a cover sheet is placed over the base sheet with the index sheet interleaved.

3. The movable index sheet unit of claim 1 in which the base sheet and movable index sheet are rectangular.

4. A movable index sheet unit comprising a base sheet having a forward and a rear edge such base sheet having a first and second spaced-apart track follower means;

a movable index sheet with forward and rear edges having slot track means to permit reciprocation of the index sheet within limits from an exposed position in which the forward index sheet edge is remote from the forward base sheet edge to retracted position;

the track follower means including tab means extending through the track slot means and bent to be oriented in a plane substantially parallel to the base sheet; and cover means connected to the base sheet on one end by hinge means and connected at the other end by flap and slot means.

* * * * *